United States Patent [19]

Yang

[11] Patent Number: 5,048,808

[45] Date of Patent: Sep. 17, 1991

[54] CLAMPING DEVICES FOR IRREGULAR SHAPED WORKPIECES

[76] Inventor: Tai-Her Yang, 5-1 Taipin St., Si-Hu Town, Dzan-Hwa, Taiwan

[21] Appl. No.: 577,073

[22] Filed: Aug. 31, 1990

Related U.S. Application Data

[63] Continuation of Ser. No. 279,912, Dec. 5, 1988, abandoned.

[51] Int. Cl.[5] ..... B25B 1/24

[52] U.S. Cl. ..... 269/258; 269/265; 269/268; 269/270

[58] Field of Search ..... 269/258, 264, 265, 268, 269/270, 279

[56] References Cited

U.S. PATENT DOCUMENTS 1,203,152 10/1916 Steudner ..... 269/258
1,344,700 6/1920 Loomis ..... 269/258
1,541,715 6/1925 Johnson ..... 269/258
3,998,445 12/1976 Goltz ..... 269/258

FOREIGN PATENT DOCUMENTS 238734 9/1987 Taiwan .

*Primary Examiner*—Frank T. Yost
*Assistant Examiner*—Scott A. Smith
*Attorney, Agent, or Firm*—Leonard Bloom

[57] ABSTRACT

A clamping device for clamping a workpiece and, in particular an irregularly-shaped workpiece is disclosed. The device includes a pair of movable jaws. Each of the jaws carries at least one clamping member, including a clamping surface, thereon for movement therewith. At least one of the clamping members is movably mounted on a respective jaw for rotational and lateral sliding movement relative to the other clamping member in response to the shape of the workpiece clamped therebetween. The clamping surfaces are shaped, so as to matingly engage one another when moved towards one another without the workpiece therebetween.

1 Claim, 2 Drawing Sheets

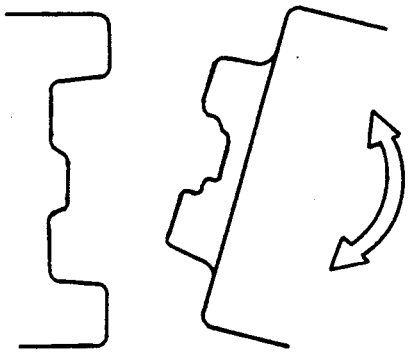
FIG. 2-6
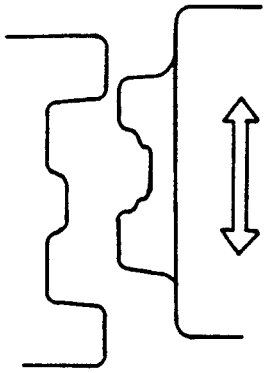
FIG. 2-7
FIG. 3
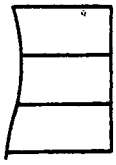
FIG. 3-1
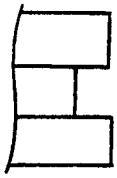
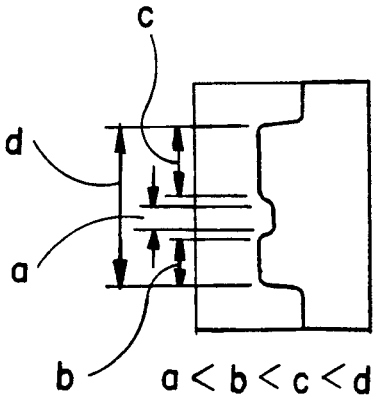
FIG. 4
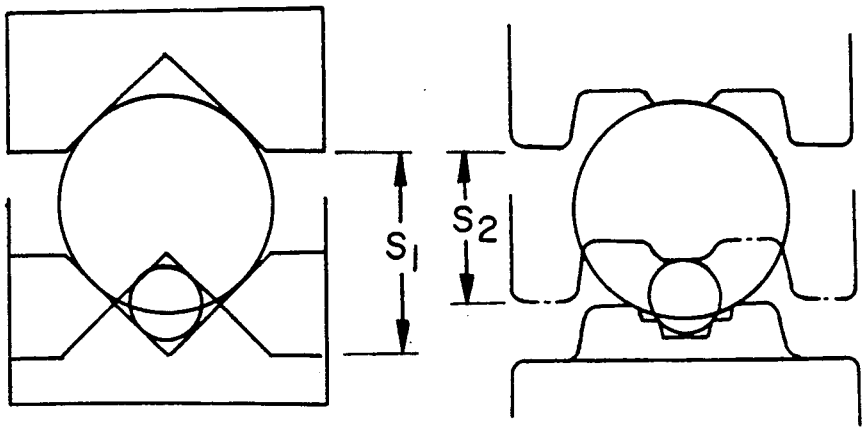
FIG. 5

CLAMPING DEVICES FOR IRREGULAR SHAPED WORKPIECES

This application is a continuation of application Ser. No. 279,912, filed Dec. 5, 1988 now abandoned.

FIELD OF THE INVENTION

The present invention relates to clamping devices for clamping irregular-shaped workpieces and, in particular, to the clamping members and clamping surfaces thereof.

BACKGROUND OF THE INVENTION

With traditional clamping devices, when an irregular-shaped workpiece is involved, the use of additional devices (auxiliary equipment), in addition to the clamping device (the clipping equipment or device), is necessary.

Further, traditional clamping devices are not equipped with opposing clamping faces that matingly engage (couple) with one another to expand its clamping (clipping) use. Also, the clamping members (chucks) of traditional clamping devices are not able to either rotate (regulate the clipping direction of vibration) or to slide laterally, so that the positioning of the clamping surfaces relative to one another can be adjusted to accommodate the shape of the workpiece. This limited their use with workpieces having certain shapes and, in particular, certain irregular shapes.

In European Patent Application No. 86301397.5, the applicant herein has disclosed a clamping device for clamping irregular-shaped workpieces. This is an advanced clamping device for clamping and holding an irregular-shaped workpiece, so that work may be performed thereon by the use of clamping members having chamfered (convex and concave faces) clamping surfaces. This clamping device also has clamping members that are able to rotate relative to one another while being slid towards one another during the clamping operation.

SUMMARY OF THE INVENTION

The primary principle of the present invention includes a jaw with at least one clamping member including a clamping face carried thereon. Preferably, this clamping face is recessed such that, in lateral cross-section the recessed portion is substantially either U-shaped having a pair of opposite end arms and, if desired a pair of shoulders formed in the opposite ends thereof, so as to give a stepped appearance or V-shaped or formed as respective cutouts. This recessed clamping face matingly engages a similarly shaped clamping face on another clamping member carried on an opposite jaw. Additionally, at least one of the clamping members is either rotatably or laterally slidably movable relative to one another, so as to be readily adaptable for use on various different workpieces and, in particular, on workpieces having irregular shapes.

Jaws can be provided, each of which have a pair of the respective clamping members therein. Further, if desired, each of the clamping members on one or both of the jaws may be rotatably and laterally slidably carried thereby, so that during the clamping operation, the respective clamping members may move as needed to suit the workpiece for providing the most secure clamping of the workpiece by maximizing the contact between the clamping surfaces of the clamping members and the workpieces.

In further accordance with the teachings of the present invention, the clamping device has a pair of opposite jaws at least one of which is operatively movable in a first direction and in a second opposite direction. In the first direction, the jaws move towards one another for clamping the workpiece therebetween. In the second opposite direction, the jaws move away from one another for unclamping the workpiece. Each of these jaws has at least one respective clamping member carried thereon for movement therewith. Each clamping member includes a clamping surface. At least one of the clamping members is movably mounted on the jaw for rotatational and lateral sliding movement relative to the members on the same and/or the other jaw in response to the shape of the workpiece clamped therebetween. Each of the clamping surfaces is shaped, so as to matingly engage one another when moved in the first direction without the workpiece therebetween.

The individual clamping surfaces of the present invention permit the aforesaid mating engagement (coupling) due to their structure and due to the ability of at least one of the clamping members being rotationally or laterally slidable on the jaw. This facilitates the stable clamping of a wide variety of irregularly-shaped workpieces which was not heretofore possible.

BRIEF DESCRIPTION OF THE DRAWINGS

FIG. 1-1 is a perspective view of one of the clamping surfaces of FIG. 1.

FIG. 1-2 is an overhead view of the clamping surfaces of FIG. 1 illustrating the rotational movement thereof.

FIG. 1-3 is an overhead view of a second embodiment of a clamping surface of the present invention.

FIG. 1-4 is an overhead view of a third embodiment of a clamping surface of the present invention.

FIG. 2 is an overhead view of a fourth embodiment of another pair of clamping surfaces of the present invention.

FIG. 2-2 is an overhead view of the clamping surfaces of FIG. 2 showing the rotational movement thereof.

FIG. 2-3 is an overhead view of the clamping surfaces of FIG. 1 showing the lateral sliding movement thereof.

FIG. 2-4 is an overhead view of a fifth embodiment of another pair of clamping surfaces of the present invention.

FIG. 2-5 is an overhead view of a sixth embodiment of yet another pair of clamping surfaces of the present invention.

FIG. 2-6 is an overhead view of the clamping surfaces of FIG. 2-5 showing the rotational movement thereof.

FIG. 2-7 is an overhead view of the clamping surfaces of FIG. 2-5 showing the lateral sliding movement thereof.

FIGS. 3 and 3-1 illustrate construction alternatives for the construction of clamping members and/or the clamping surfaces thereof of the present invention.

FIG. 4 illustrates the clamping surfaces and the various dimensions thereof of the present invention.

FIG. 5 illustrates and compares the clamping of workpieces by, at left, a traditional device and, at right, by the device of the present invention, showing how the present invention has a smaller distance between the clamping surfaces thereof than the traditional devices.

DESCRIPTION OF PREFERRED EMBODIMENTS

Figure 1:
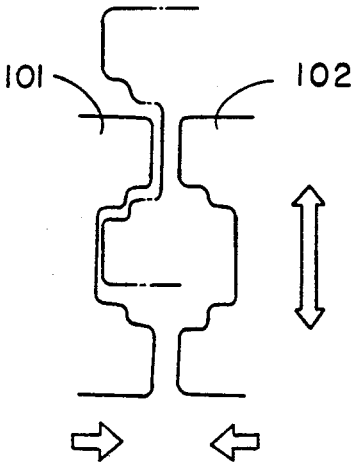
FIG. 1 is an overhead view of one embodiment of a pair of clamping surfaces of the present invention showing the movement of the clamping members and the surfaces thereof, and also showing, in phantom lines, the positioning of the clamping surfaces when one of the clamping surfaces has been slid laterally.
Figure 1:
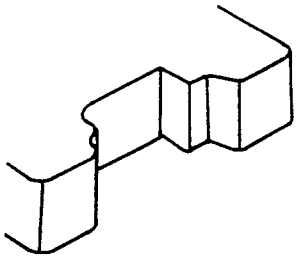
Figures 1, 2:
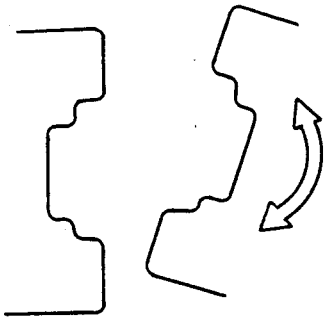

With reference now to FIGS. 1, 1-1 and 1-2, the preferred embodiment of the shape of the clamping surface of the clamping members (chucks) carried by opposite jaws (not illustrated) is illustrated. A first clamping member 101 and a second clamping member 102 are mounted on opposing jaws. The jaws receive drive threads or are otherwise movable in a first direction towards one another for clamping a workpiece therebetween and in a second opposite direction away from one another for unclamping the workpiece.

As seen therein, the clamping surfaces are shaped, so as to matingly engage one another when moved in the first direction without the workpiece therebetween.

As seen therein, the clamping surfaces of these clamping members are substantially U-shaped with a pair of opposite side arms and, if desired, with a shoulder formed in each respective corner thereof. In this fashion, this structure gives the entire recessed portion a "stepped" appearance. There may be a single shoulder formed in each opposite end of the recess (a single indented structure) or in paris or sets of several pairs of progressively larger or smaller shoulders (a poly indented structure).

Figures 1, 2, 3:
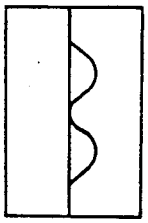
Figures 1, 2, 3, 4:
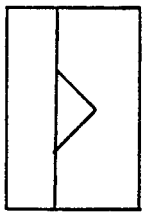

Alternatively, with reference to FIG. 1-3, the clamping surfaces of the clamping members can have substantially curved cutouts formed therein. In a further alternative, with reference to FIG. 1-4, the recesses may be formed, if desired, in a substantially V-shaped recess in the clamping surface of the clamping members.

With further particular reference to FIG. 1 and 1-2 when the clamping surfaces of the first and second clamping members are the same, then at least one of the two clamping members may either:

be rotatably carried by the jaw (FIG. 1-2), so that at least one of the opposite end arms of at least one of the clamping members will be aligned for matingly engaging the other by being received within the recess of the other of the clamping members (meeting in mutual combination); or be slid laterally on the clamping jaw (FIG. 1), so that one of the opposite end arms of one of the clamping members will be aligned for matingly engaging the other by being received within the recess of the other of the clamping members (meet and combine without parallel).

With reference now to the remainder of the drawings, the clamping surfaces of the first and second clamping members may be formed, so that the clamping surfaces of at least one of these members has at least one protrusion (a protruded chuck structure) while the other of the clamping surfaces of at least one of the clamping members recesses formed therein, whereby the clamping surfaces including at least one of the shoulders matingly engage (or are nested within) one another. (See for example, FIG. 2)

If desired, the clamping surfaces may be formed so that the upper portion of one of the clamping surfaces and further so that the lower portion of the other of the clamping surfaces have respective protrusions formed thereon. In this fashion, when the clamping members formed with such clamping surfaces are moved in the first direction without a workpiece therein, the clamping surfaces matingly engage (couple) or nest with one another, with one protrusion being located above the other (FIGS. 2-1 and 2-5). In such a case, each protrusion may also have a recess formed therein, such as the V-shaped recess discussed above with reference to FIGS. 2-1 and 2-5, for further clamping operations (as seen in FIG. 5).

One of the clamping members may also be laterally slidable (FIG. 2-3) or rotatably (FIG. 2-2) carried by a respective jaw to provide for more flexibility for the clamping of irregular-shaped workpieces. Preferably, in such cases the size of the protrusions of one of the clamping surfaces will be smaller than the recess (the indented sector) of the other clamping face (as shown in FIG. 2-2).

Lateral sliding of the clamping member carrying the clamping surface having the protrusion formed thereon permits the workpiece to be clamped between the protrusion and one of the shoulders formed in a recess (FIG. 2-3). Such an arrangement is especially useful for clamping small workpieces.

With reference now to FIGS. 2-4, 2-6 and 2-7, if desired, the clamping surface of one of the clamping members may have a pair of spaced U-shaped recesses formed therein including respective opposite end arms. In such a case, the clamping surfaces of the other of the clamping members have a pair of spaced protrusions formed therein. In this fashion, when moved in the first direction, the protrusions extend into respective recesses, so that the clamping surfaces matingly engage one another. As with the other embodiments discussed above, if desired, at least one of the clamping members may be either rotatably (FIG. 2-6) or laterally slidably (FIG. 2-7) carried by the jaw. This further increases the flexibility thereof for use in clamping irregular-shaped workpieces therebetween.

If desired, the recesses that are formed between protrusions may also have shoulders formed in opposite sides thereof (a poly convex and concave mutual make-up type) FIG. 2-7.

The clamping surfaces of the present invention described above may thus be utilized which contains the following features:

A. a pair of opposite jaws capable of moving in a first direction towards one another for clamping a workpiece therebetween and in a second opposite direction away from one another for unclamping a workpiece located therebetween; and B. at least one clamping member laterally slidingly carried by its respective jaw; or C. at least one clamping member being rotatably carried by each of the jaws for use with workpieces having faces located on different angles (irregularly-shaped workpieces); or D. at least one clamping member that is both laterally slidably and rotatably carried by its respective jaw, as is described above in B and C.

A clamping surface (chuck jowl) and/or a clamping member (a chuck) having a clamping surface can be made either as a single integral piece (a block of chuck jowl chuck sets or a block of chuck jowl and second chucks). Alternatively, the clamping surfaces and/or clamping members may be fabricated from a series of thin strips (poly sets of thin pieces) that are stacked on (piled up) and secured to one another (FIG. 3 and 3-1). If desired, as seen in FIG. 3-1, some of the strips may be shorter (or longer), or otherwise offset from one another to form the recesses and the protrusions (tangs). Further, each individual strip, if desired, can have smaller indented shapes (i.e., shoulders) formed therein and/or thereon.

In practical use, by forming the protrusions and recesses in various shapes, clamping surfaces can be formed that have a variety of functions, such as a press-tang for the pressing of wire connection ends. Thus, highly diverse shapes, such as that seen in FIG. 4, wherein each of the sections a, b, c and d are made of different sizes can also be useful. Such multi-sized clamping surfaces can also be useful in maximizing the clamping of workpieces by allowing the workpiece to be clamped within a section thereof, which is perfectly sized to clamp it.

Figure 2:
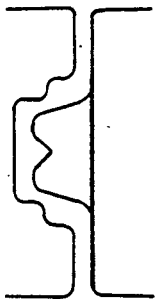
Figures 1, 2:
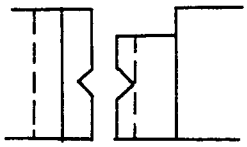
Figure 2:
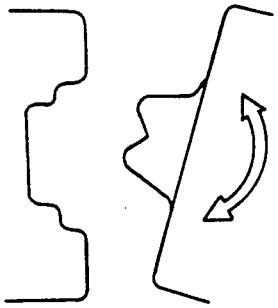
Figures 2, 3:
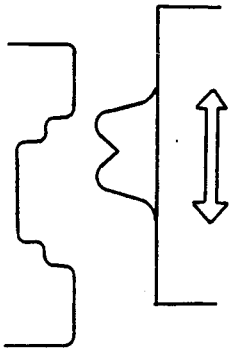
Figures 2, 3, 4:
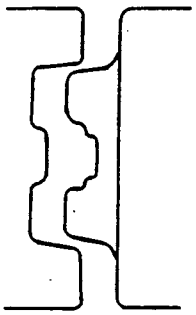
Figures 2, 3, 4, 5:
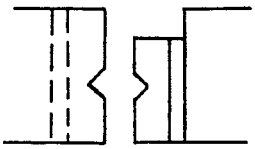

As shown in FIG. 5, this advantage is illustrated with a traditional round workpiece. On left, a traditional clamp is seen clamping a large workpiece. The distance between the clamping surfaces (S1) is relatively large. As for small workpieces, as can be seen in phantom lines on left, clamping of such a small piece could not occur because the clamping surfaces would have to overlap to affect clamping. However, as seen on the right, when utilizing the mating recess/protrusion clamping surface arrangements of the present invention, not only can the smaller piece be clamped, but when the larger workpiece is clamped, the distance between the two clamping surfaces (S2) is smaller than that distance (S1) which traditionally occurred. Thus, more stable clamping occurs that requires the application of lesser amounts of force to effectuate clamping of a workpiece. Such features are of even greater importance when irregular-shaped workpieces are clamped.

Obviously, many modifications may be made without departing from the basic spirit of the present invention. Accordingly, within the scope of the appended claims, the invention may be practiced other than specifically disclosed herein.

What is claimed is:

1. In a clamping device for clamping a workpiece, the device being of the type having a pair of opposite jaws, at least one of said jaws being operatively movable in a first direction towards the other jaw for clamping the workpiece therebetween, and in a second opposite direction away from the other jaw for unclamping the workpiece, the device further being of the type having at least one respective clamping member disposed on each of the jaws, each clamping member including a clamping surface carried thereon for movement therewith and at least one of the clamping members being movably mounted on one of the opposite jaws for rotational and lateral sliding movement relative to the other clamping member in response to the shape of the workpiece clamped therebetween, wherein each of the clamping surfaces has a respective U-shaped recess formed therein terminating in a pair of opposite end arms, so that a respective corner is defined between each end arm and the recess and wherein a respective shoulder is formed in each corner of each surface, so that when the movably mounted clamping members are laterally slid and are moved in the first direction, each of the clamping surfaces and the shoulders of each clamping surface matingly engage one another.

* * * * *